United States Patent [19]

Küng et al.

[11] Patent Number: 4,549,582

[45] Date of Patent: Oct. 29, 1985

[54] APPARATUS FOR REMOVING SEVERED FABRIC PARTS FROM A WEAVING MACHINE

[75] Inventors: Walter Küng, Tann-Dürnten; Stefan Svarc, Rüti, both of Switzerland

[73] Assignee: Maschinenfabrik Sulzer-Rüti AG, Rüti, Switzerland

[21] Appl. No.: 612,337

[22] Filed: May 21, 1984

[30] Foreign Application Priority Data

Jun. 6, 1983 [EP] European Pat. Off. ..... 83810236.6

[51] Int. Cl.[4] ..... D03D 47/40

[52] U.S. Cl. ..... 139/430; 139/291 C; 139/302

[58] Field of Search ..... 139/429, 430, 291 R, 139/291 C, 302, 303, 430; 66/145 S; 26/10.4, 96

[56] References Cited

U.S. PATENT DOCUMENTS 3,175,588 3/1965 Angle .
3,744,533 7/1973 Yano et al. ..... 139/430
4,453,572 6/1984 Key ..... 139/430

FOREIGN PATENT DOCUMENTS 2620894 5/1976 Fed. Rep. of Germany .
2385299 11/1979 Fed. Rep. of Germany .

*Primary Examiner*—Henry Jaudon
*Attorney, Agent, or Firm*—Werner W. Kleeman

[57] ABSTRACT

The apparatus comprises an injector nozzle, for instance on the loom take-up roll. The injector nozzle has a plurality of air supply passages or channels opening into an extraction conduit surrounding the selvedge to be removed or extracted. The selvedge is pulled through the injector nozzle by the air coming out of the air supply passages and conducted through a tube or hose into a waste container. The injector nozzle for extracting cut-off fabric parts is especially suited for sensitive materials, e.g. glass fiber yarns. When for instance the selvedge contains severed weft thread ends of glass fiber material, the latter are particularly well protected against breakage due to the extracting injector nozzle.

6 Claims, 5 Drawing Figures

APPARATUS FOR REMOVING SEVERED FABRIC PARTS FROM A WEAVING MACHINE

BACKGROUND OF THE INVENTION

The present invention broadly relates to weaving machines and, more specifically, pertains to a new and improved construction of an apparatus for the extraction of severed or cut-off fabric parts from a weaving machine or loom.

Generally speaking, the apparatus of the present invention is intended for the removal or extraction of severed or cut-off fabric parts at the edge or selvedge of a fabric produced on a weaving machine, e.g. selvedges or protruding weft thread or pick ends and the like.

In hitherto known weaving machines, when for instance an auxiliary edge or selvedge is formed at the catch side of the fabric and is severed or cut-off with a cutter device, the selvedge is conducted between two mutually meshing gears and transported for instance into a waste container.

In other known machines, the selvedge is removed by a suction nozzle at the edge of the fabric, which is connected to a blower. The selvedge is transported through a hose into a waste container.

Similarly, other known weaving machines provide for the suction removal of protruding, severed or cut-off pick or weft thread ends and their transport to a waste container.

Known apparatus for the removal of severed fabric parts, especially for selvedges or pick ends, are not suited for fabrics which have sensitive yarn in the weft or warp or both, for instance glass fiber threads or particularly smooth, thin fibers such as synthetic fibers or the like. Such fabric parts to be removed are destroyed in the known types of gear transmissions intended to remove them. The glass fibers break, disengage from the weave of the selvedge and fall downward. They can then not be collected in a waste container. Sensitive yarns can only be removed in a suction nozzle by the application of powerful air currents with correspondingly great consumption of air. There is a danger that the selvedges will be blown apart.

SUMMARY OF THE INVENTION

Therefore, with the foregoing in mind, it is a primary object of the present invention to provide a new and improved construction of an apparatus for the removal of severed fabric parts from a weaving machine which does not have associated with it the aforementioned drawbacks and shortcomings of the prior art constructions.

Another more specific object of the present invention aims at providing a new and improved construction of an apparatus of the previously mentioned type in which an injector nozzle at the region of the edge of the fabric being produced generates a substantially conically convergent air stream of jet surrounding the fabric part to be removed.

Yet another specific object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that an injector nozzle is arranged at the region of the edge of the fabric being woven and generates a substantially conically convergent air jet or stream which surrounds the fabric part to be removed or extracted.

Experiments have shown that it is possible to remove even selvedges consisting of very fine material and not having a very great inherent strength of its selvedge, such as for instance selvedges containing glass fiber yarns, with an apparatus of this type. The air consumption is relatively low even though particularly high air velocities can be generated in the injector nozzle. These velocities can be, for example, 140 to 150 meters per second. For comparison, if a suction blower is to generate a similar velocity of the suction removal air, it must have an extremely high output or capacity, which leads to high operating costs.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
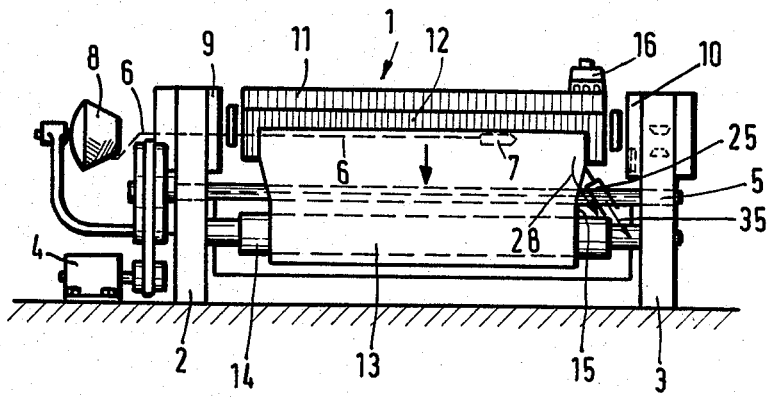
FIG. 1 schematically illustrates a weaving machine fitted out with the invention and as seen from the fabric side.

Describing now the drawings, it is to be understood that to simplify the showing of the drawings only enough of the structure of the apparatus for removing severed fabric parts from a weaving machine or loom has been illustrated therein as is needed to enable one skilled in the art to readily understand the underlying principles and concepts of this invention. The illustrated exemplary embodiment of the apparatus will be seen to be installed on a weaving machine or loom 1 shown in FIG. 1 and comprises side frames 2 and 3, a drive motor 4, a main shaft 5, a pick or weft thread supply roll or spool 8 arranged outside of the loom shed, a picking or shot mechanism 9, a catch mechanism 10, harnesses 11, a reed 12, a fabric rool or breast beam 14 and a false or twist selvedge device 16 mounted at the catch side of the machine 1.

Figure 3:
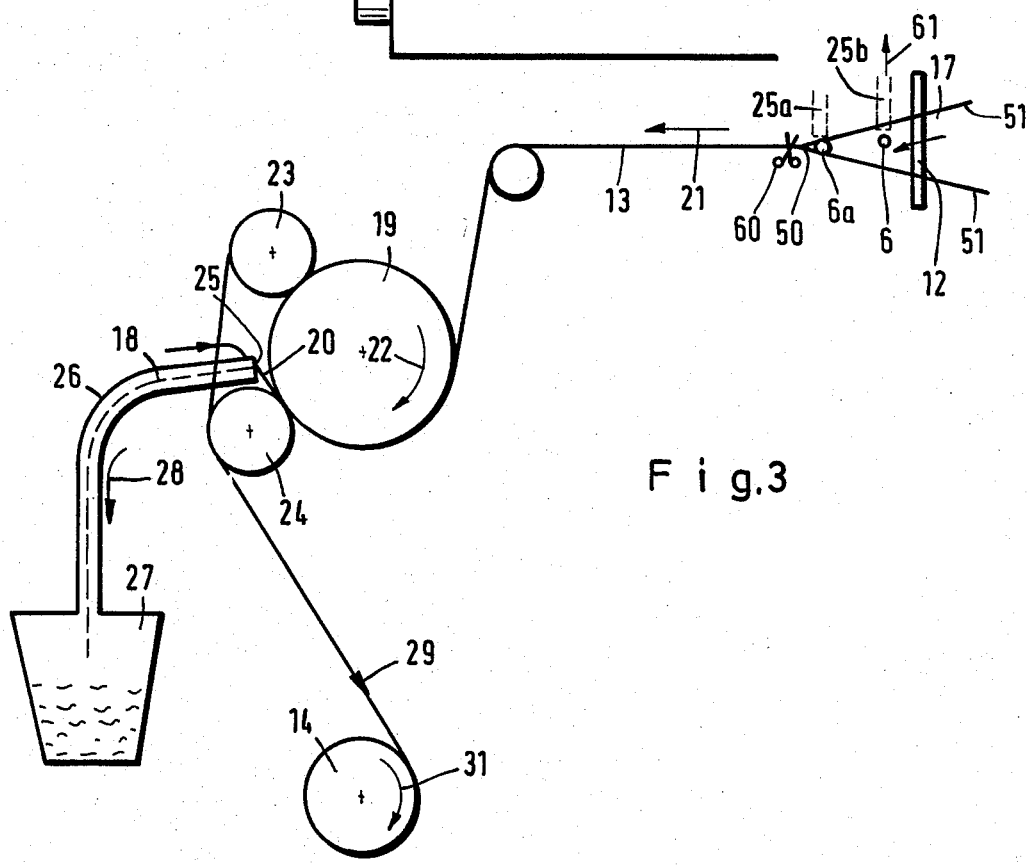
FIG. 3 is a side view associated with FIG. 2.

The filling or weft thread 6 is carried, for instance by means of a shuttle 7 or by means of an air jet, from the supply roll or spool 8 into the loom shed 17 to produce the fabric or cloth 13. The fabric 13 has an auxiliary edge or selvedge 18 at its catch side edge 15 produced by the false selvedge or twist device 16, which is cut-off or severed by a shear 60 following the reed beat-up motion at the fell 50 of the fabric being woven as can be seen in FIG. 3.

The fabric and the catch-side selvedge 18 are withdrawn according to the arrows 21 and 22 by a loom or fabric take-up roll 19. Subsequently, the selvedge 18 is removed at the removal position 20 by an injector nozzle designated in its entirety by reference numeral 25 and is conducted through a hose or conduit 26 into a waste container 27 in the direction of the arrow 28.

Following the removal position 20, the fabric 13, after it has been freed of the selvedge 18, is wound over the guide rolls 23 and 24 in the direction of the arrow 29 and onto the rotating fabric roll or breast beam 14 in the direction of the arrow 31.

The injector nozzle 25 comprises a conduit or tube 33 which forms a removal channel. Compressed air is conducted through an air supply conduit 36 in the direction of the arrow 35 into an annular space or chamber 37 formed in an annular insert 38. From the annular space 37 the air passes in the direction of the arrows 41 through several air supply passages or channels 39 arranged on a circle and into the conduit or tube 33. The longitudinal axes 42 of the air supply passages 39 intersect at a point 45 and define an angle A of about 20° with respect to the longitudinal axis 43 of the conduit or tube 33.

Downstream of the air supply passages or channels 39, an axially adjustable constricting insert 48 with sealing gaskets 47 is inserted to impart a venturi acceleration to the air stream. The insert 48 is positioned such that its initial or entry cone 49 surrounds the point 45.

Figure 4:
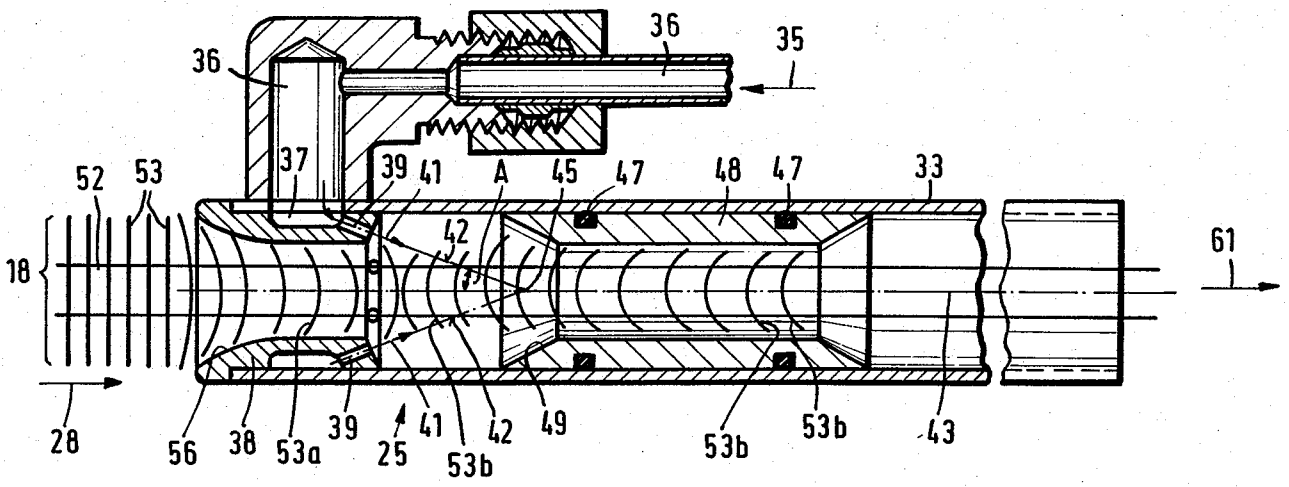
FIG. 4 is a schematic longitudinal section through the apparatus of the invention on an enlarged scale.

The selvedge 18 entering from the left in FIG. 4 consists of a middle skein or strand 52 containing several warp threads 51 in which the severed or cut-off weft threads or fillings 53 are woven in and restrained by the false twist produced by the false or twist selvedge device 16. The weft thread ends 53 consist of the same material as the weft threads 6, for instance glass fiber material, in consequence of which selvedge 18 has only a weak inherent strength. The weft thread ends 53 can particularly easily break and fall out of the middle skein or strand 52.

The selvedge 18 is conducted into the injector nozzle 25 in the direction of the arrow 28 shown in FIG. 4 by the air conducted through the air supply passages or channels 39, and the weft thread ends 53 assume the curved position **53*a* due to the curvature 56 of the insert 38. In this position, they wipe their ends along the curved interior circumference or inner surface of the insert 38**.

After leaving the insert or insert member 38, the weft thread ends 53 are transformed into the reversed curved position **53*b* by the air entering through the air supply passages 39 and are transported or pushed further to the right in FIG. 4 by the air flow. In this form, the selvedge 18 passes through the venturi insert 48 and is conducted onward in the direction of the arrow 61 through the tube or hose 26 into the waste container 27**.

Figure 5:
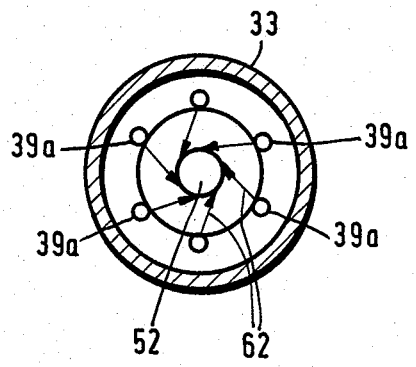
FIG. 5 is a schematic detail view of a modified embodiment of the invention.
Figure 2:
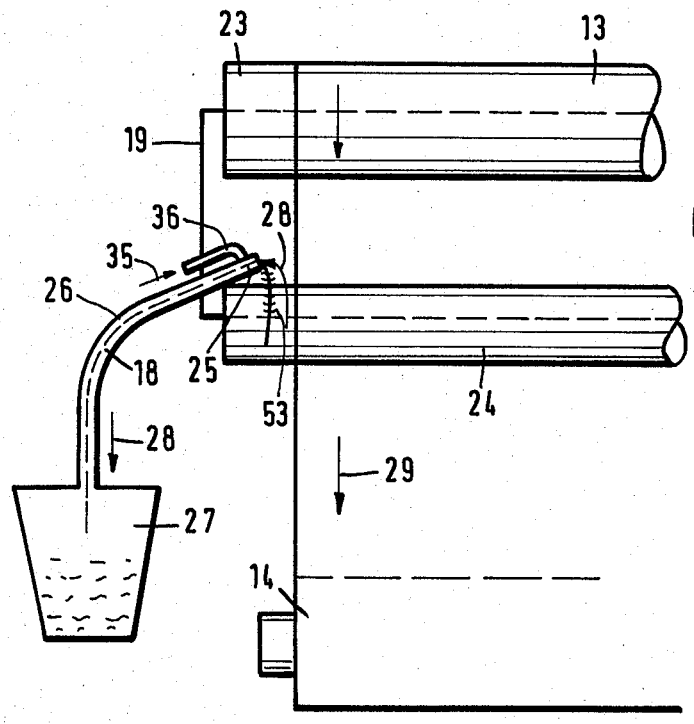
FIG. 2 schematically illustrates the arrangement of the removal apparatus on an enlarged scale.

In a modified embodiment of the invention shown in FIG. 5, air supply passages or channels **39*a* are employed which are arranged in skew fashion in the annular insert 38 and generate a rotary or rotating air flow or current, that is they impart a twist to the air stream, in the injector nozzle 25 in the direction of the arrows 62. This enables the generation of a so-called false twist in the selvedge 18** which coils and strengthens it.

By removing the selvedge 18 by means of the individual air jets or streams emanating from the air supply passages 39 or **39*a* selvedges 18 having particularly sensitive weft thread ends 53 are protected and nevertheless subjected to a relatively strong removal action. These weft thread ends 53 then do not tend to break and cannot fall out of the skein or strand 52, so that the selvedge 18** can be removed without damage.

In another application of the removal-injector nozzle 25, weft thread ends 53 protruding from the loom shed 17 and to be cut-off are removed. The injector nozzle 25 is then arranged directly at the position where the weft thread ends are cut-off, preferably in the extension of the weft or shot line, i.e. the extension of the weft thread 6 in FIG. 3. In this case the injector nozzle **25*b* can be positioned perpendicular to the weft thread 6 as is indicated in broken lines in FIG. 3. The injector nozzle 25*b* is then moved into the position 25*a* and the weft thread is moved into the position 6*a* when the reed 12 beats up the fell 50** of the fabric being woven.

The air supply via the air supply conduit 36 and the air supply passages 39 can be continuous or pulsed according to a predetermined rhythm or pattern corresponding to the operating cycle of the weaving machine, preferably at the time of arrival of the weft threads at the catch side of the weaving machine in the catch mechanism 10. A device corresponding to the false selvedge device 16 and an injector nozzle 25 for the removal of a selvedge or of weft thread ends can also be provided at the picking or shot mechanism side of the weaving machine 1.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for removing fabric parts such as selvedges, protruding warp thread ends and the like severed at the edge of a fabric produced on a weaving machine, comprising:

an injector nozzle arranged at the region of an edge of the fabric being woven;

said injector nozzle generating a substantially conically convergent air jet;

said air jet surrounding the fabric part to be removed;

a removal conduit provided for said injector nozzle;

said removal conduit surrounding the fabric parts to be removed;

said removal conduit comprising a plurality of individual air supply passages;

said air supply passages being directed away from a shed of the weaving machine;

said removal conduit having a longitudinal axis; and said air supply passages being arranged skew to said longitudinal axis of the removal conduit for generating a rotary air current acting upon the fabric parts to be removed.

2. The apparatus as defined in claim 1, wherein:

said removal conduit comprising constriction means arranged downstream of said air supply passages; and said constriction means providing a venturi nozzle acceleration.

3. An apparatus for removing fabric parts such as selvedges, protruding warp thread ends and the like severed at the edge of a fabric produced on a weaving machine, comprising:

an injector nozzle arranged at the region of an edge of the fabric being woven;

said injector nozzle generating a substantially conically convergent air jet;

said air jet surrounding the fabric part to be removed;

said injector nozzle comprising a removal conduit;

said removal conduit comprising a plurality of individual air supply passages;

the removal conduit having a longitudinal axis; and said air supply passages each defining an acute angle with respect to said longitudinal axis of the removal conduit.

4. The apparatus as defined in claim 3, wherein;

said acute angle is substantially equal to 20°.

5. An apparatus for removing fabric parts such as selvedges, protruding warp thread ends and the like severed at the edge of a fabric produced on a weaving machine, comprising:

an injector nozzle arranged at the region of an edge of the fabric being woven;

said injector nozzle generating a substantially conically convergent air jet;

said air jet surrounding the fabric part to be removed;

said injector nozzle comprises a removal conduit containing a plurality of individual air supply passages;

said removal conduit comprising constriction means arranged downstream of said air supply passages;

said constriction means providing a venturi nozzle acceleration;

said removal conduit having a longitudinal axis;

said constriction means is formed by a separate venturi insert inserted into said removal conduit; and sand venturi insert being slideably translatable in the direction of said longitudinal axis.

6. An apparatus for removing fabric parts such as selvedges, protruding warp thread ends and the like severed at the edge of a fabric produced on a weaving machine, comprising:

an injector nozzle arranged at the region of an edge of the fabric being woven;

said injector nozzle generating a substantially conically convergent air jet;

said air jet surrounding the fabric part to be removed;

said injector nozzle comprising a removal conduit containing a plurality of individual air supply passages;

said removal conduit comprising constriction means arranged downstream of said air supply passages;

said constriction means providing a venturi nozzle acceleration;

said removal conduit having a longitudinal axis;

said air supply passages having longitudinal axes; and said longitudinal axes of the air supply passages intersecting said longitudinal axis of the removal conduit at an initial upstream region of said constriction means providing said venturi nozzle acceleration.

* * * * *